US012410929B2

(12) United States Patent
Gury et al.

(10) Patent No.: US 12,410,929 B2
(45) Date of Patent: Sep. 9, 2025

(54) RAPID RESTART CHILLER SYSTEM

(71) Applicant: TRANE INTERNATIONAL INC., Davidson, NC (US)

(72) Inventors: Raphael Gury, Thaon les Vosges (FR); Lee L. Sibik, Onalaska, WI (US); Philippe Del Marcel Tisserand, Eloyes (FR)

(73) Assignee: TRANE INTERNATIONAL INC., Davidson, NC (US)

( * ) Notice: Subject to any disclaimer, the term of this patent is extended or adjusted under 35 U.S.C. 154(b) by 186 days.

(21) Appl. No.: 17/729,747

(22) Filed: Apr. 26, 2022

(65) Prior Publication Data

US 2022/0349605 A1 Nov. 3, 2022

(30) Foreign Application Priority Data

Apr. 30, 2021 (EP) ..... 21171469

(51) Int. Cl.
*F24F 11/49* (2018.01)

(52) U.S. Cl.
CPC ..... *F24F 11/49* (2018.01)

(58) Field of Classification Search
CPC ..... F25B 2600/0252; F25B 2700/15; F24F 11/37
See application file for complete search history.

(56) References Cited

U.S. PATENT DOCUMENTS 5,323,619 A * 6/1994 Kim ..... F24F 11/30 62/193
8,406,929 B2 3/2013 Duncan
(Continued)

FOREIGN PATENT DOCUMENTS

| | | | | |
|---|---|---|---|---|
| CN | 1255192 | A | | 5/2000 |
| CN | 107590016 | A | | 1/2018 |
| CN | 209783026 | U | | 12/2019 |
| JP | 10122604 | A | * | 5/1998 |
| JP | H10122604 | A | * | 5/1998 |
| WO | 98/43025 | A2 | | 10/1998 |

OTHER PUBLICATIONS

Daikin, "Air and Water cooled inverter chillers and heat pump", Operation Manual, pp. 1-78, Mar. 1, 2018, Available online at URL: https://www.daikin.co.uk/content/dam/document-library/operation-manuals/as/EWAD-TZ-B, EWAH-TZB,EWWD-VZ,EWWH-VZ_D-EOMZC00106-17_01EN_Operation%20manual_English.pdf.
(Continued)

*Primary Examiner* — Jianying C Atkisson
*Assistant Examiner* — Meraj A Shaikh
(74) *Attorney, Agent, or Firm* — HSML P.C.

(57) ABSTRACT

Chiller systems can include a controller that is configured to determine whether to restart the chiller in a rapid restart mode or a soft loading restart mode, and methods can include determining the mode for restarting the chiller. The soft loading restart mode controls the chiller to provide a comparatively gradual loading, to avoid overshooting a target temperature. The rapid restart mode more aggressively loads the chiller to return more rapidly to a particular load level. The determination of the restarting mode can be based on characteristics of the interruption of power to the chiller system. In chiller systems, the controller can receive power from an uninterruptable power source to maintain continuity of power. The logic used by the controller can be based on whether or not the controller shares continuity of power with other components of the chiller system.

9 Claims, 5 Drawing Sheets

(56) References Cited

U.S. PATENT DOCUMENTS

| | | | | |
|---|---|---|---|---|
| 8,872,379 | B2 | 10/2014 | Ruiz et al. | |
| 2011/0113797 | A1* | 5/2011 | Peyaud | F25B 49/02 62/84 |
| 2016/0047584 | A1* | 2/2016 | Bahel | F25B 49/005 62/115 |
| 2019/0178513 | A1* | 6/2019 | Ma | F25B 31/006 |

OTHER PUBLICATIONS

Berry, "New feature reduces time for restarting chillers", pp. 1-11, Feb. 12, 2010, available online at URL: https://www.engineeringnews.co.za/article/new-feature-can-shorten-chiller-restart-time-by-75-2010-02-12/rep_id:4136 (2 pages provided).

Extended European Search Report; European Patent Application No. 21171469.6, Oct. 11, 2021 (8 pages).

Johnson Controls, "The fastest chiller restart after power failure", 2 pages (2009), available online at URL: https://www.johnsoncontrols.com/~/media/jci/be/united-states/hvac-equipment/chillers/files/be_yk_res_quickstart_sg.pdf?la=en.

Trane, "When the power goes out, Trane keeps it cool", 2 pages (2020), available online at URL: https://www.trane.com/content/dam/Trane/Commercial/global/products-systems/equipment/chillers/air-cooled/RTAC-SLB001-EN_07042020.pdf.

Extended European Search Report issued in European Patent Application No. 23220100.4, Apr. 4, 2024 (9 pages).

Anonymous. "Magnitude Magnetic Bearing Chillers", Feb. 1, 2012, p. 25, URL:https://www.google.com/url?sa=t&rct=j&q=&esrc=s&source=web&cd=&ved=2ahUKEwjK8fzEg4CFAxWq9gIHHTe8BkoQFnoECBoQAQ&url=https%3A%2F%2Foslo.daikinapplied.com%2Fapi%2Fsharepoint%2Fgetdocument%2FDoc100%2FOMM_1008-2_Daikin_McQuay.pdf%2F&usg=AOvVaw3J36nlhAvrgilGdk2Ex3X7&opi=89978449.

* cited by examiner

RAPID RESTART CHILLER SYSTEM

FIELD

This disclosure is directed to chiller systems configured to be rapidly restarted following interruptions in the supply of power to the chiller.

BACKGROUND

Chillers can be used in applications where there is a constant, high demand for the removal of heat, for example to cool data centers or support industrial processes. Chillers are often electrically powered, and can shut down when power is interrupted. Chillers typically are configured to avoid overshooting target temperatures since this can lead to major failures such as freezing of process fluid. Chillers can have constrained rates of loading during startup operations to avoid such overshooting. The controllers for chillers are typically powered from the same power source, and need to go through a rebooting process when power is restored, slowing the restoration of chiller function.

SUMMARY

This disclosure is directed to chiller systems configured to be rapidly restarted following interruptions in the supply of power to the chiller.

By using power configurations that provide superior continuity of power to chiller controllers, even when the chiller itself suffers an interruption in power, the controller remains powered and thus controller rebooting processes can be avoided in some embodiments, increasing the speed of response in restarting the chiller.

A rapid restart mode for a chiller can be an appropriate response to some power interruptions to allow high, constant chiller loads such as data center cooling to be met and maintained even where the chiller suffers an interruption in the supply of power. The rapid restart mode can aggressively load the chiller compared to a soft loading restart mode, more rapidly responding to chiller demand when it is unlikely that the chiller would overshoot a target temperature. By using the conditions regarding the power interruption to determine whether to use the rapid restart mode or the soft loading restart mode, the controller can determine whether it is more important to rapidly respond to demand, for example after a brief interruption, or whether it is more important to avoid overshooting a target temperature, for example when bringing a chiller initially online or when starting the chiller in staging operations in a multi-chiller system. The rapid restart mode can thus be added as an operational option while reducing or avoiding the risks typically associated with aggressive chiller loading on start-up.

In an embodiment, a chiller system includes a chiller and a controller. The controller is configured to determine a restarting mode for the chiller, when power to the chiller is restored following an interruption. The restarting mode is one of a soft loading restart mode or a rapid restart mode. The controller is further configured to control the chiller according to the determined restarting mode. The soft loading restart mode includes a limit on a rate of increase for chiller capacity. The rapid restart mode reestablishes chiller capacity to a level at which the chiller was operation prior to the interruption more rapidly than the soft loading restart mode.

In an embodiment, the controller is configured to determine the restarting mode based on an operational state of the chiller at a time of interruption of power to the chiller.

In an embodiment, the controller is configured to receive power from an uninterruptable power source. In an embodiment, the controller is configured to determine the restarting mode based on a duration of interruption of power to the chiller compared to a threshold duration. In an embodiment, the chiller system itself includes the uninterruptable power source.

In an embodiment, the system further includes a circuit configured to detect when power is interrupted at the chiller, and wherein the controller is configured to receive a signal from the circuit, the signal indicative of when power is interrupted at the chiller.

In an embodiment, the controller is configured to, when the restarting mode is determined to be the rapid restart mode, control the chiller according to the rapid restart mode until the chiller reaches a capacity corresponding to a current load on the chiller.

In an embodiment, the rapid restart mode is an adaptive rapid restart mode wherein the rate of increase for chiller capacity is determined based on the level at which the chiller was operating at prior to the interruption more rapidly than the soft loading restart mode.

In an embodiment, a method of controlling a chiller system includes determining when power to a chiller of the chiller system has been interrupted. The method then includes receiving power at the chiller of the chiller system, determining, using a controller, whether to restart the chiller in a soft loading restart mode or a rapid restart mode, and operating the chiller, using the controller, according to the determined restarting mode. The soft loading restart mode includes a limit on a rate of increase for chiller capacity. The rapid restart mode reestablishes chiller capacity to a level at which the chiller was operation prior to the interruption more rapidly than the soft loading restart mode.

In an embodiment, determining whether to restart the chiller in the soft loading restart mode or the rapid restart mode is based on an operational state of the chiller at a time of interruption of power to the chiller.

In an embodiment, determining whether to restart the chiller in the soft loading restart mode or the rapid restart mode is based on a duration of interruption of power to the chiller compared to a threshold duration.

In an embodiment, the controller receives power from an uninterruptable power source. In an embodiment, determining when power to the chiller is interrupted includes detecting the interruption at a circuit and receiving at the controller a signal from the circuit.

In an embodiment, when it is determined to restart the chiller in the rapid restart mode, the method includes controlling the chiller according to the rapid restart mode is performed until the chiller reaches a capacity corresponding to a current load on the chiller.

In an embodiment, the rapid restart mode is an adaptive rapid restart mode and wherein the method further includes determining the rate of increase for chiller capacity based on the level at which the chiller was operation prior to the interruption more rapidly than the soft loading restart mode.

DRAWINGS

DETAILED DESCRIPTION

This disclosure is directed to chiller systems configured to be rapidly restarted following interruptions in the supply of power to the chiller.

Figure 1:
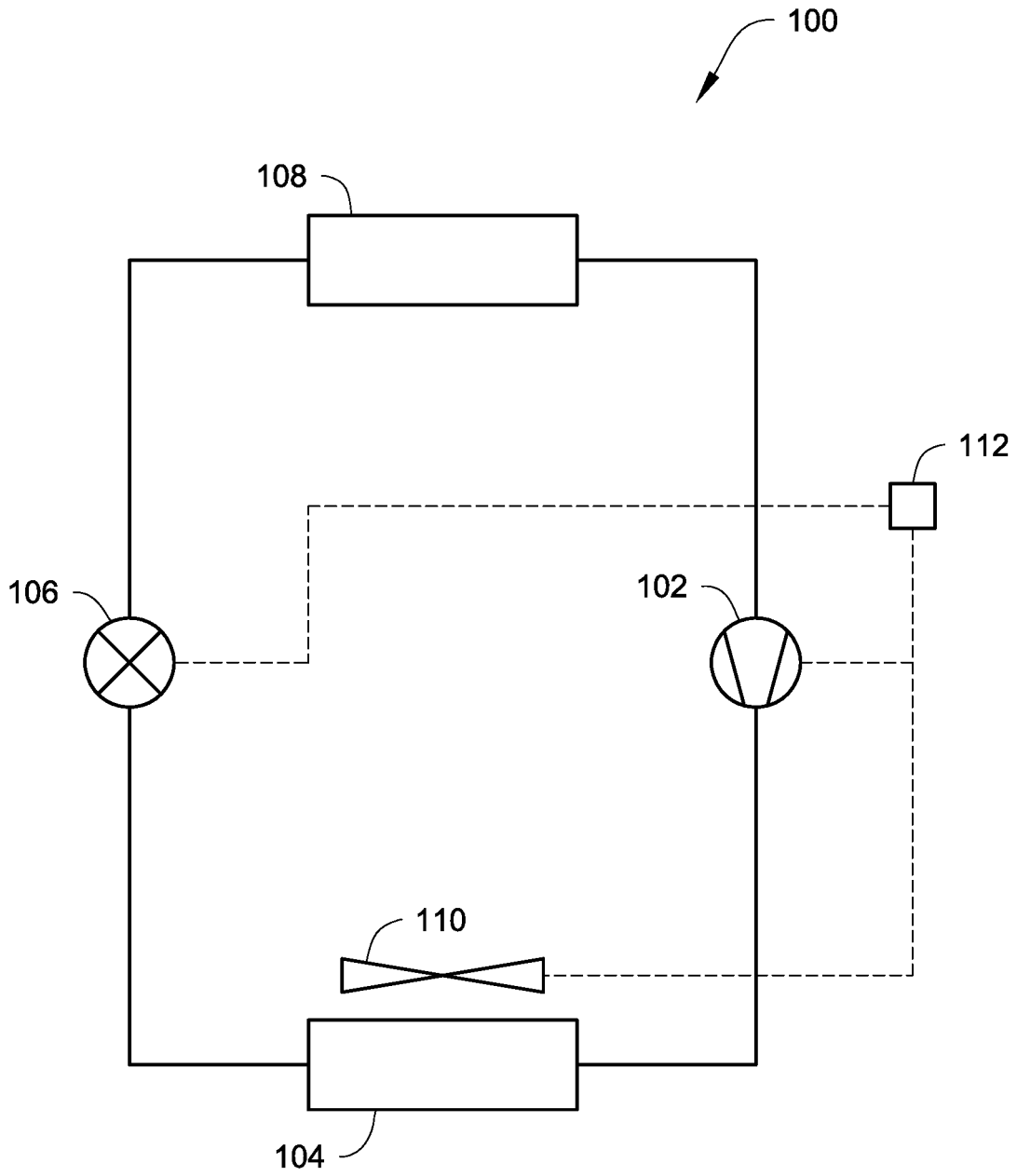
FIG. 1 shows a schematic of a chiller system according to an embodiment.

FIG. 1 shows a schematic of a chiller according to an embodiment. Chiller system 100 includes compressor 102, condenser 104, expander 106, and evaporator 108. A condenser fan 110 can be included. A controller 112 can also be included, with controller 112 being operatively connected to components of the chiller system, such as but not limited to the compressor 102, condenser fan 110, and the like.

Compressor 102 can be any suitable compressor for compressing a working fluid of the chiller system 100. Compressor 102 may be, for example, a centrifugal compressor, scroll compressor, screw compressor, or any other suitable type of compressor for use in a working fluid circuit of chiller system 100. Compressor 102 can be controlled by controller 112, for example to adjust operation of the compressor 102 such as the capacity at which compressor 102 is operated and/or any other suitable controls for operation of compressor 102. In an embodiment, multiple compressors 102 may be included in chiller system 100.

Condenser 104 includes a heat exchanger. Condenser 104 receives compressed working fluid from compressor 102, and the working fluid rejects heat via the heat exchanger at condenser 104. The rejection of heat at condenser 104 condenses the working fluid to a liquid. Condenser 104 may be in thermal communication with an ambient environment or a source fluid, and reject heat to that ambient environment or source fluid. One or more condenser fans 110 may provide airflow over the condenser 104. The operation of the one or more condenser fans 110 may be controlled by controller 112. Operation of the condenser fans 110 by controller 112 can be used at least in part to control the capacity at which chiller system 100 is operated.

Expander 106 is configured to reduce the pressure of the working fluid. As a result, a portion of the working fluid is converted to a gaseous form. Expander 106 may be, for example, an expansion valve, orifice, or other suitable expander to reduce pressure of a refrigerant such as the working fluid. In an embodiment, expander 106 includes multiple orifices. In an embodiment, the multiple orifices of expander 106 have different sizes. Expander 106 may be a controllable expander having a variable aperture. In an embodiment, expander 106 is an electronic expansion valve. Expander 106 may be controlled by controller 112 to adjust its effects on flow and expansion of the working fluid, for example by controlling aperture size of an expansion valve or the number and size of orifices in use based on a signal from controller 112. Control of expander 106 by controller 112 can be used at least in part to control the capacity at which chiller system 100 is operated.

Evaporator 108 receives working fluid from expander 106. Evaporator 108 includes a heat exchanger where the working fluid can absorb heat, for example absorbing heat from a liquid process fluid that can be used to provide cooling to an area served by chiller system 100. This process fluid exchanges heat with the working fluid in the evaporator 108, which absorbs heat from the process fluid and evaporates the working fluid.

Controller 112 is a controller that controls the components of chiller system 100. Controller 112 can direct operation of components of the chiller system including, as non-limiting examples, the compressor 102, the expander 106, condenser fan(s) 110, and the like. Controller 112 can include one or more processors and one or more storage memories. The controller 112 can direct the restarting of the chiller system 100 following inactivation or loss of power. Controller 112 can be configured to determine whether to restart the chiller system 100 in a soft loading restart mode or a rapid restart mode. The determination of the restart mode can be made according to information regarding the interruption of power to the chiller system 100. The determination of the restart mode can be according to a method particular to the power supply connections of controller 112 and other components of chiller system 100, for example whether controller 112 is separately powered from the chiller system 100. Non-limiting examples of the determination of the restart mode are provided in FIGS. 5 and 6 and described below. Controller 112 can further carry out the determined restart mode, for example by controlling one or more of compressor 102, expander 106 condenser fan(s) 110 and/or any other components of chiller system 100 to control the rate of increase in the capacity of chiller system 100 following the restarting of the chiller system 100. In the soft loading restart mode, the increase in chiller capacity can be made gently to avoid overshooting a target temperature for the process fluid, for example to avoid freezing of the process fluid or other damaging conditions from occurring. In the rapid restart mode, the increase in chiller capacity upon restart can be comparatively more aggressive, with less regard to the risk of overshooting and a more rapid increase in the capacity of chiller system 100 during the restarting process.

Powered components of the chiller system 100 can include, for example, the compressor 102, the expander 106, the condenser fan 110, and/or any other suitable component of chiller system 100 requiring a supply of power in order to function. It is understood that the chiller system powered components can also include, for example, power operated valves, other fans, pumps, and the like. These powered components require power from a power source to function, and may cease operation during interruptions in the supply of power to the chiller system 100. As described below and shown in FIGS. 2A and 2B, the controller 112 may be supplied power alongside the other powered components of chiller system 100 or may receive power from another source such as an uninterruptable power source (UPS)

Figure 2A:
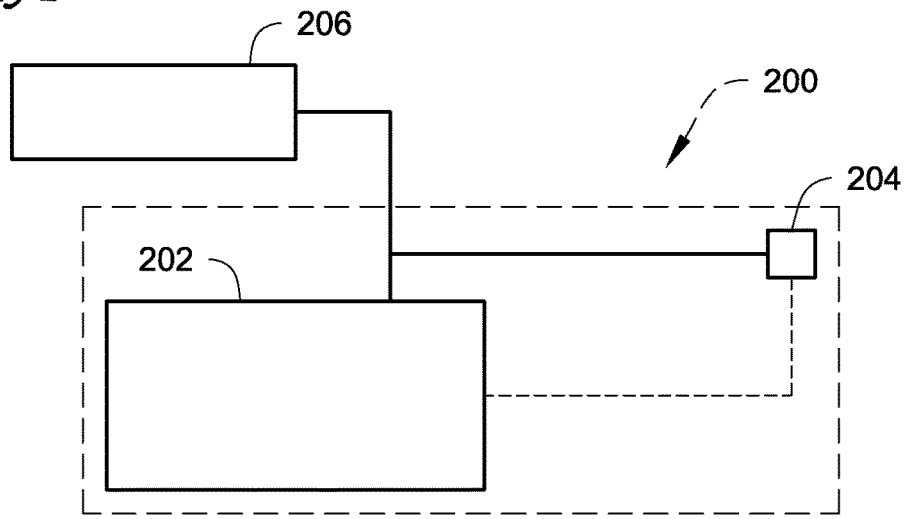
FIG. 2A shows a schematic of power connections for a chiller system according to an embodiment.

FIG. 2A shows a schematic of power connections for a chiller according to an embodiment. Chiller system 200 includes both chiller powered components 202 and controller 204, which both receive power from a power source 206. Chiller powered components 202 include any suitable chiller components aside from the controller 204 that are supplied power to enable their operation. The chiller powered components 202 include, as non-limiting examples, one or more compressors, one or more fans such as condenser fans, pumps, valves, or any other suitable component of a chiller system 200. The controller 204 is a controller configured to operate chiller system 200 such as the controller 112 described above and shown in FIG. 1. Both chiller powered components 202 and controller 204 receive power from power source 206 by a common connection. When power from the power source 206 to the chiller system 200 is interrupted, chiller components 202 cease operation as they are not supplied power. Controller 204 also ceases operation due to also losing power due to the interruption in power from power source 206. When power is restored, chiller powered components 202 can be operated again. When power is restored, controller 204 resumes operation. In an embodiment, controller 204 goes through a rebooting process when resuming operation following restoration of power after an interruption. The controller 204 can include logging of its own power status. The power status of controller 204 can be known to correspond to the power status of the chiller powered components 202 since both are receiving power from power source 206 by common connections.

Figure 2B:
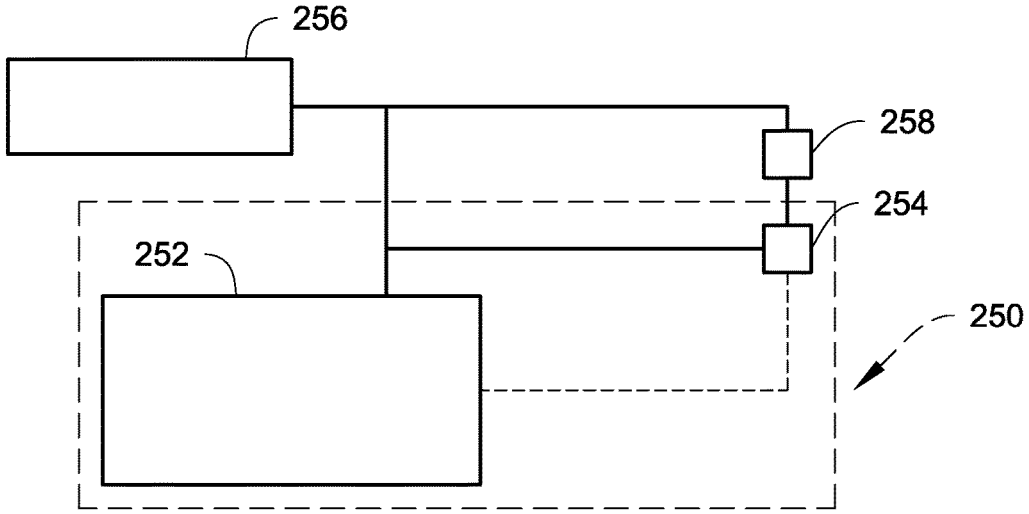
FIG. 2B shows a schematic of power connections for a chiller according to an embodiment.

FIG. 2B shows a schematic of power connections for a chiller according to an embodiment. Chiller system 250 includes chiller powered components 252 and controller 254. Chiller powered components 252 receive power directly from power source 256. Controller 254 receives power from an uninterruptable power source (UPS) 258 which also receives power from power source 256. UPS 258 is a power source configured to receive power from power source 256 and provide power to controller 254. UPS 258 can receive power from power source 256. UPS 258 can be any suitable power source for providing power with the ability to maintain power supply over at least some interruptions in power from power source 256. UPS 258 can include any suitable additional power source for maintaining continuity of the supply of power despite an interruption in power source 256, such as power storage. In an embodiment, UPS 258 can be separate from chiller system 250, with a connection to supply power from UPS 258 to controller 254. In an embodiment, UPS 258 can be included in chiller system 250 itself. When the UPS 258 is separate from chiller system 250, it can be incorporated into a utility connection for chiller system 250, incorporated into the installation such as building or data center where the chiller system 250 is used, or the like. When UPS 258 is included in chiller system 250, it can be provided as part of the chiller, as part of a control module of chiller system 250, or the like. When UPS 258 is included in chiller system 250, it can be powered by the power connection providing power to chiller powered components 252. Chiller system 250 includes both chiller powered components 252 and controller 254. Chiller powered components 252 include any suitable chiller components aside from the controller 254 that are supplied power to enable their operation. The chiller powered components 252 include, as non-limiting examples, one or more compressors, one or more fans such as condenser fans, pumps, valves, or any other suitable component of a chiller system 250. The controller 254 is a controller configured to operate chiller system 250 such as the controller 112 described above and shown in FIG. 1. Chiller powered components 252 receive power from power source 256. Power source 256 also provides power to UPS 258. UPS 258 supplies power to controller 254. When power from the power source 256 to the chiller system 250 is interrupted, chiller components 252 cease operation as they are not supplied power. For at least a portion of the time power from power source 256 is interrupted, controller 254 continues to receive power from UPS 258. The power status of controller 254 is distinct from the power status of chiller powered components 252. The controller 254 may obtain information regarding the power status of chiller powered components 252, for example from a power sensing circuit such as power sensing circuit 304 described below and shown in FIG. 3. The controller 254 may operate while powered by UPS 258 during the interruption to power source 256. The controller 254 may not require rebooting following the interruption to power source 256 when the UPS 258 powers the controller 254 for the entirety of the interruption to power source 256.

Figure 3:
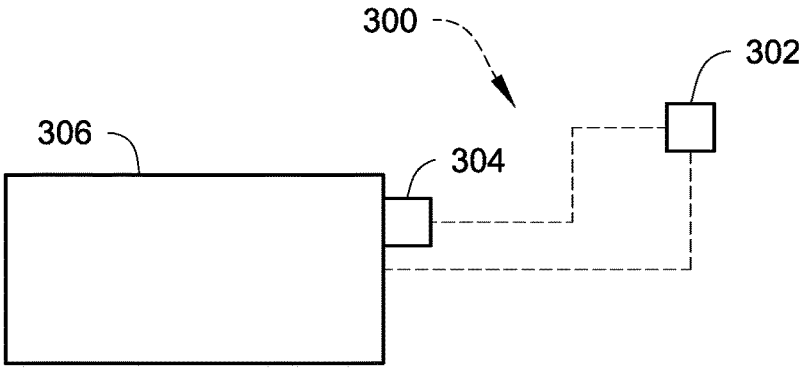
FIG. 3 shows a schematic of control and chiller circuits according to an embodiment.

FIG. 3 shows a schematic of control and chiller circuits according to an embodiment. Control circuit 300 includes controller 302 and power sensing circuit 304. Power sensing circuit 304 measures whether power is being supplied to the chiller circuit 306.

Controller 302 can be the controller of the chiller system, such as controller 112 of chiller system 100 as described above and shown in FIG. 1 and/or the controllers 204, 254 of FIGS. 2A/2B. In the embodiment including power sensing circuit 304, the controller 302 can be powered such that continuity of power at controller 302 is not entirely dependent on a continuity of power at chiller circuit 306. For example, controller 302 can receive power from an uninterruptable power source (UPS), for example UPS 258 as described above and shown in FIG. 2B.

Power sensing circuit 304 is configured to determine whether chiller circuit 306 is receiving power. Power sensing circuit 304 can be any suitable circuit or other sensor for detecting whether chiller circuit 306 is currently powered. Power sensing circuit 304 can report the power status of chiller circuit 306 to the controller 302, such that controller 302 is provided with the power status of chiller circuit 306. In an embodiment, power sensing circuit 304 can report the power status of chiller circuit 306 continuously. In an embodiment, power sensing circuit 304 can report the power status of chiller circuit 306 at events where the power status changes, such as the beginning and end of interruptions to the power supply to chiller 306. By providing power sensing circuit 304, the controller 302 can have accurate information regarding the power status of chiller circuit 306 even when the power continuity at chiller circuit 306 can differ from the power continuity experienced by controller 302 itself.

Chiller circuit 306 is the electrical circuit supplying power to the powered chiller components other than controller 302, for example, compressors, condenser fans, expanders, valves, pumps, and any other such components included in the chiller system including control circuit 300. When chiller circuit 306 experiences in interruption in the supply of power, the chiller system may be incapable of operation due to a lack of power to the powered components which allow the chiller system to function.

Figure 4:
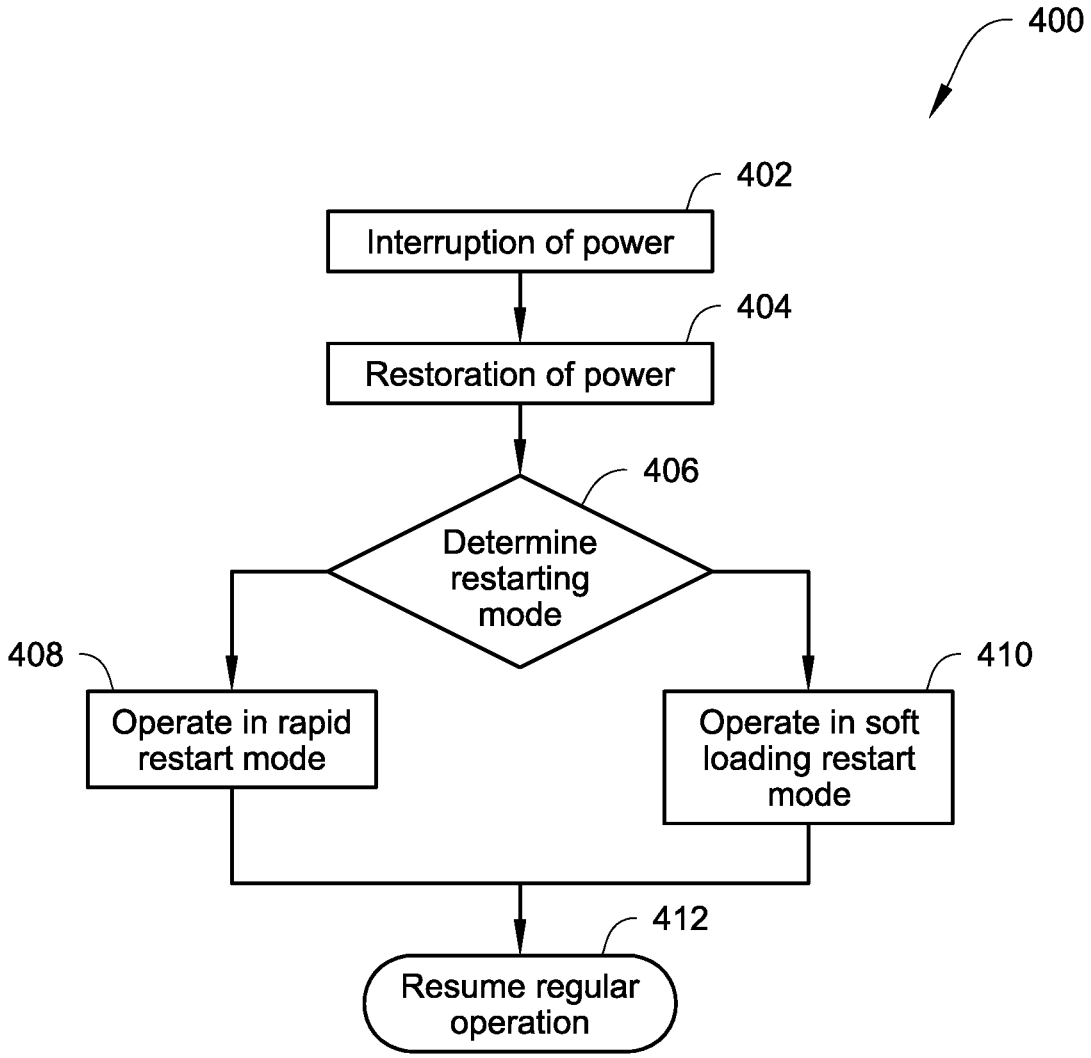
FIG. 4 shows a flowchart of control of a chiller according to an embodiment.

FIG. 4 shows a flowchart of control of a chiller according to an embodiment. Method 400 includes an interruption of power to the chiller 402 and a resumption of power at 404. Method 400 includes determining a restart mode for the chiller at 406. When it is determined to that the restart mode is a rapid restart mode at 406, the chiller can be restarted according to the rapid restart mode at 408. When it is determined that the restart mode is a soft loading restart mode at 406, the chiller can be restarted according to the soft loading restart mode at 410. Following the restarting according to the determined mode, the chiller can resume regular operation at 412.

Interruption of power 402 is an interruption in the supply of power from a power source to the chiller. The interruption can be, for example, due to loss of power from a utility, failure at local generation facilities, faults in the system conveying power to the chiller system, or any other disruption of the supply of power to the chiller system. Upon the interruption of power 402, the powered chiller components may shut down due to the lack of power being supplied. In an embodiment, a controller of the chiller system may maintain continuity of power while the other powered chiller components shut down, for example by way of power being supplied to the controller using an uninterruptable power source (UPS).

Restoration of power 404 can follow the interruption of power 402. Restoration of power 404 can result from the cause of the interruption of power at 402 being remedied, activation of another supply of power such as backup generation, or any other suitable restoration of power to the powered chiller components. The restoration of power at 404 is a restoration of power such that the chiller powered components can be operated, allowing the chiller system to function.

Upon or following the restoration of power at 404, a restart mode is determined at 406. The restart mode can be determined based on the characteristics of the interruption of power 402 and when it is ended by the restoration of power 404. In an embodiment, the restart mode can be determined based on the duration from the beginning of the interruption of power 402 until the restoration of power 404. In an embodiment, the restart mode can further be determined based on an operational state of the chiller system at the time of the interruption of power. In an embodiment, the restart mode can further be based on other input(s) regarding the interruption of power at 402, for example whether the interruption was part of the staging of multiple chiller systems, whether the interruption was part of a user-directed shutdown, or other characterizations of or reasons for the interruption of power at 402. The restart mode can be determined to be a rapid restart mode or a soft loading restart mode. The rapid restart mode can be determined when the factors for the determination at 406 are indicative of the demand for chiller capacity at the restoration of power at 404 being relatively high and immediate. For example, a brief interruption such as a power outage, where the chiller system was operating at a high capacity prior to the interruption, can lead to the determination to restart in the rapid restart mode. The soft loading restart mode can be determined as the restart mode when the factors for the determination are not indicative of immediate, high demand for the capacity of the chiller system. For example, the soft loading restart mode can be determined at 406 when the demand for capacity of the chiller system is unknown or known to be either low or not urgent. An example of where demand for capacity is low and/or not urgent can be where the chiller system was deactivated as part of chiller staging with other chiller systems operating. An example of where demand for capacity is unknown is where significant time has passed since the last operation of the chiller, for example where the duration from the interruption of power at 402 to the restoration of power at 404 is greater than a predetermined period of time. The predetermined period of time can be based on the characteristics of the installation including the chiller system. The determination of the restart mode at 406 can be according to a method particular to the respective power sources for the chiller powered components and the controller for the chiller system, for example the methods provided in FIGS. 5 and 6 and described below. In an embodiment, the determination of the restart mode at 406 can include user input, for example, presenting a prompt and accepting a user input indicative of whether to restart in the rapid restart mode or the soft loading restart mode.

Restarting the chiller according to the rapid restart mode 408 includes increasing the capacity of the compressor at an accelerated rate compared to a soft loading restart mode. The restarting according to the rapid restart mode at 408 by way of more aggressive increases in the capacity that the compressor is operated at, with corresponding control of other components such as condenser fans, expanders, and the like to support the more aggressive increase in capacity in the rapid restart mode. Non-limiting examples of controls that can be used to restart in the rapid restart mode include reducing of staging timers that control loading of the compressor, increasing gains in modulation of the compressor capacity, loosening or eliminating restrictions on discharge pressure, loosening or eliminating restrictions on the supply of electrical current to the compressor, and combinations thereof. The more aggressive increase can more rapidly bring the chiller to a capacity matching a known or approximated demand, which can be based on the conditions at the interruption of power at 402. The rapid restart mode at 408 can bring the chiller to previous operating capacity (for example, 80% capacity) within at or about three to five minutes of initiating operation in the rapid restart mode. In an embodiment, the rapid restart mode 408 can include disabling features outside of the increase in compressor capacity, such as free cooling or heat recovery modes. The rapid restart mode at 408 can be continued until a target is reached. In an embodiment, the target is a predetermined value for capacity, such as a particular fraction of maximum capacity for the chiller system. In an embodiment, the target is a predetermined period of time. In an embodiment, the target is a dynamic value based on the particular conditions regarding the interruption of power or immediately prior, such as the duration from the interruption of power at 402 to the restoration of power at 404, a capacity at which the chiller system was being operated prior to the interruption of power at 402, or the like. When the target is reached, the rapid restart mode 408 ends and the chiller transitions to normal operations 412.

In an embodiment, the rapid restart mode carried out at 408 can be an adaptive rapid restart mode. The control parameters used to more aggressively increase for the capacity at which the chiller system is operated during the rapid restart mode at 408 can be variable values. The variable values can be determined based on the particular conditions regarding the interruption of power or immediately prior, such as the duration from the interruption of power at 402 to the restoration of power at 404, a capacity at which the chiller system was being operated prior to the interruption of power at 402, or the like. In an embodiment, the control parameters can be dynamically adjusted during the adaptive form of the rapid restart mode 408, for example based on compressor loading, demand on the chiller, temperature response in the system cooled by the chiller, or the like. The rate of increase for the capacity at which the chiller system is operated can be based on relative need for rapid increase in capacity in relation to the potential risk of overshooting the desired capacity.

Restarting the chiller according to the soft loading restart mode 410 includes a controlled increase in the capacity at which the chiller system is operated. The soft loading restart mode can be a relatively more gradual increase in capacity compared to the rapid restart mode that can be operated in at 408. The soft loading restart mode 410 can include controlling one or more powered components of the chiller system to slowly increase the capacity of the chiller over time. The soft loading restart mode can include control of one or more parameters of the chiller to balance chiller capacity with the load on the chiller, such as cooling demands of a building, computing devices in a data center, or the like. In an embodiment, the control in the soft loading restart mode 410 can be based on controlling evaporator fluid temperature to achieve a particular desired value without overshooting the desired value, for example by decreasing the rate of capacity increase as the evaporator fluid temperature nears the desired target. This can necessarily slow the rate of capacity increase in the soft loading restart mode 410 compared to the rapid restart mode 408, which proceeds directly to a target capacity. The increase in capacity during the soft loading restart mode 410 can be performed over a longer period of time to reach the same capacity compared to the rapid restart mode 408. The longer time to reach a particular capacity can vary based on the particular respective controls for each mode, with the soft loading restart mode 410 taking, for example, up to approximately eight times as long to reach a particular capacity compared to the rapid restart mode 408 or an adaptive rapid restart mode as discussed above. In an embodiment, the soft loading restart mode can take at or about 15 minutes from the beginning of the restart for the chiller to reach full capacity. The soft loading restart mode 410 can include secondary functions to increase efficiency or energy savings or to satisfy additional chiller functions, such as heat recovery modes or utilization of free cooling. The soft loading restart mode 410 can be operated until a target is reached. The target can be, for example, a particular period of time to operate in the soft loading restart mode 410, a target capacity for operation of the chiller, or any other suitable definition of a point at which to end a soft loading restart mode 410.

When the rapid restart mode 408 or the soft loading restart mode 410 concludes, for example when the target is reached for that mode, the chiller system can resume normal operations 412, for example operating according to controls for regular operations, such as to provide cooling for a building interior, a data center, or the like.

Figure 5:
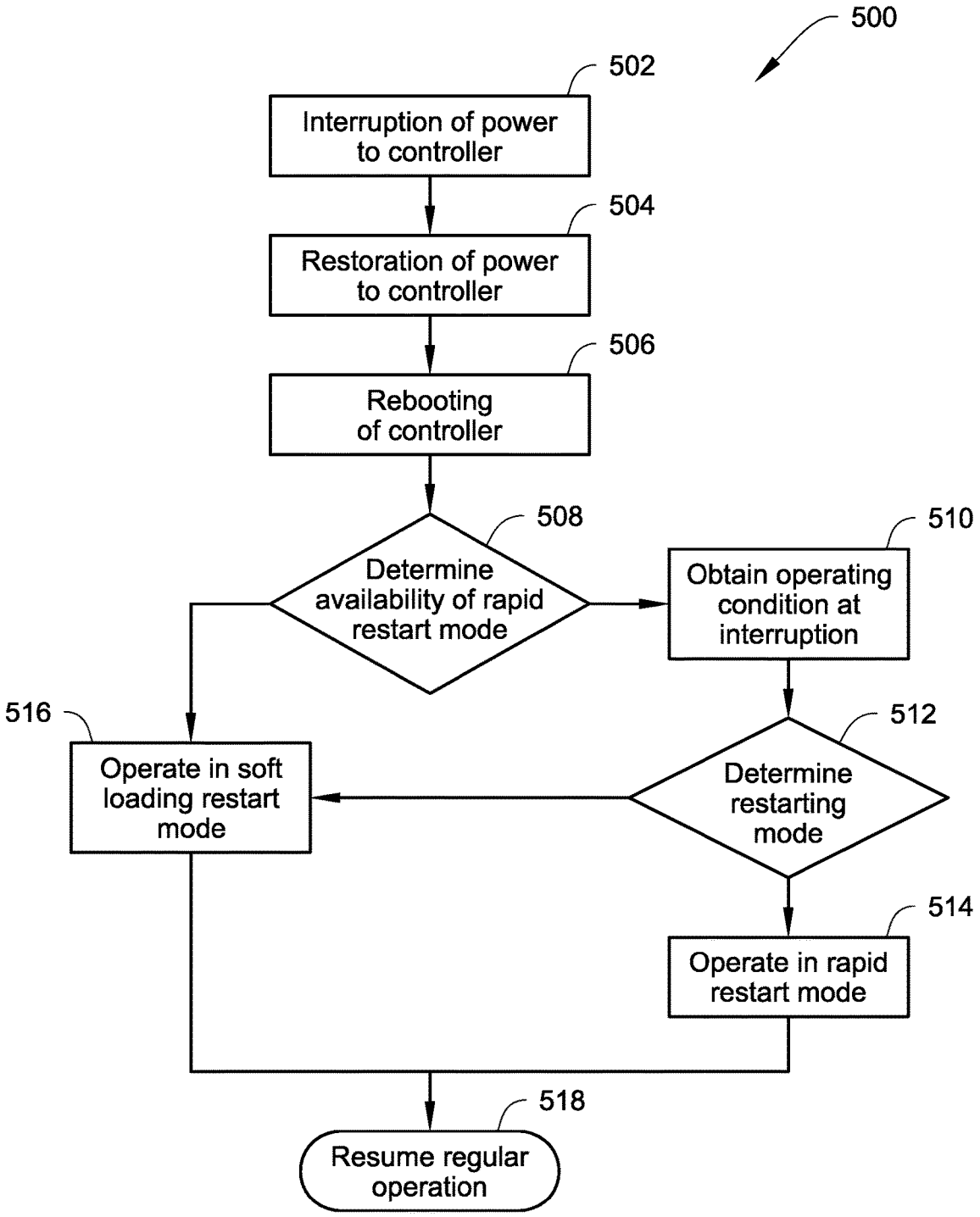
FIG. 5 shows a flowchart for determining a restarting mode according to an embodiment.

FIG. 5 shows a flowchart for determining a restarting mode according to an embodiment. In method 500, a controller experiences an interruption of power at 502. The controller experiences a restoration of power at 504. The controller reboots at 506 following the restoration of power at 504. Optionally, the controller checks whether a rapid restart capability is enabled 508. The controller obtains an operating condition at the time of interruption 510. The controller determines the restarting mode for the chiller 512. When the restarting mode determined at 512 is a rapid restart mode, the chiller is restarted according to the rapid restart mode 514. When the restarting mode determined at 512 is a soft loading restart mode, the chiller is restarted according to the soft loading restart mode 516. Following restarting according to the rapid restart mode 514 or restarting according to the soft loading restart mode 516, the chiller system can enter regular operation 518.

The controller experiences an interruption of power at 502. In the embodiment where method 500 is used, the controller shares a power source with the other powered components of the chiller system. Thus, when the interruption of power at 502 occurs, the interruption of power affects the controller as well as the other powered components of the chiller system, shutting down the controller as well as ceasing operation of the other powered components of the chiller system. The interruption of power can be any interruption in the supply of power to the chiller system, for example as described above.

The controller experiences a restoration of power at 504. When power is restored at 504, the controller restarts operations. Since the interruption of power at 502 affected the controller, the controller reboots at 506. The rebooting of the controller at 506 can be according to any startup or restarting procedure programmed into the controller used in the chiller system.

Optionally, following or as part of rebooting at 506, the controller can determine whether a rapid restart mode is enabled at 508. The controller can reference a memory storing data regarding whether the rapid restart mode is enabled. The memory can store, for example, user input, factory settings, or other directions regarding whether the controller can select and operate in the rapid restart mode. When it is determined at 508 that the rapid restart mode is not enabled, the method 500 can proceed directly to restarting the chiller in the soft loading restart mode 516.

When the rapid restart mode is determined to be enabled, or if there is not a check for enabling of the rapid restart mode at 508, an operating condition at the time of the interruption can be obtained 510. The operating condition at the time of interruption can include whether the chiller was currently being operated, a capacity at which the chiller was being operated, whether the chiller was in the process of being deactivated, or any other suitable information indicative of chiller operation at the time of the interruption of power. In an embodiment, the operating condition can be obtained from a log of chiller operations being kept by the controller. In this embodiment, the point in the log closest to or at the time of the interruption of power at 502 can be references to obtain the operating condition. The operating condition can include one or more of a duration of the interruption, a capacity at which the chiller was operating at the time of the interruption, or the like. In an embodiment, the operating condition can be obtained from another device, such as, as a non-limiting example, a central controller interfacing with the controller of the chiller system.

Based on the operating condition obtained at 510, a restarting mode for the chiller system can be determined at 512. In an embodiment, the restarting mode for the chiller system at 512 can be determined based on whether the chiller system was in operation at or immediately prior to the interruption of power at 502. In this embodiment, when the chiller system was being operated at the time of the interruption of power at 502, it can be determined at 512 to restart the chiller in a rapid restart mode. In this embodiment, when the chiller system was not being operated at the time of the interruption of power at 502, it can be determined at 512 to restart the chiller in a soft loading restart mode. Examples of the chiller system not being operated at the time of the interruption of power can include when the chiller is deactivated due to control staging multiple separate chillers, the chiller being turned off, or other such controlled or intended deactivations. In an embodiment, the time between the interruption of power at 502 and the restoration of power at 504 can further be incorporated into the determination of the restarting mode 512.

When it is determined at 512 to restart in the rapid restart mode, the chiller system can be restarted according to the rapid restart mode at 514. The rapid restart mode 514 can be a more aggressive approach to restarting the chiller system and increasing capacity of the chiller during the restarting process, as described above with respect to rapid restart mode 408 described above. In an embodiment, the rapid restart mode carried out at 514 can be an adaptive rapid restart mode as discussed above. The rapid restart mode 514 can continue until a target is reached, at which point the chiller system can enter regular operations 518.

When it is determined at 512 to restart in the soft loading restart mode, or when it is determined at 508 that the rapid restart mode is not enabled, the chiller system can be restarted according to the soft loading restart mode at 516. The soft loading restart mode 516 can provide a comparatively slower, more tightly constrained increase in capacity of the chiller system during the restarting process, as described above with respect to soft loading restart mode 410 described above. The soft loading restart mode 516 can continue until a target is reached, at which point the chiller system can enter regular operations 518.

Figure 6:
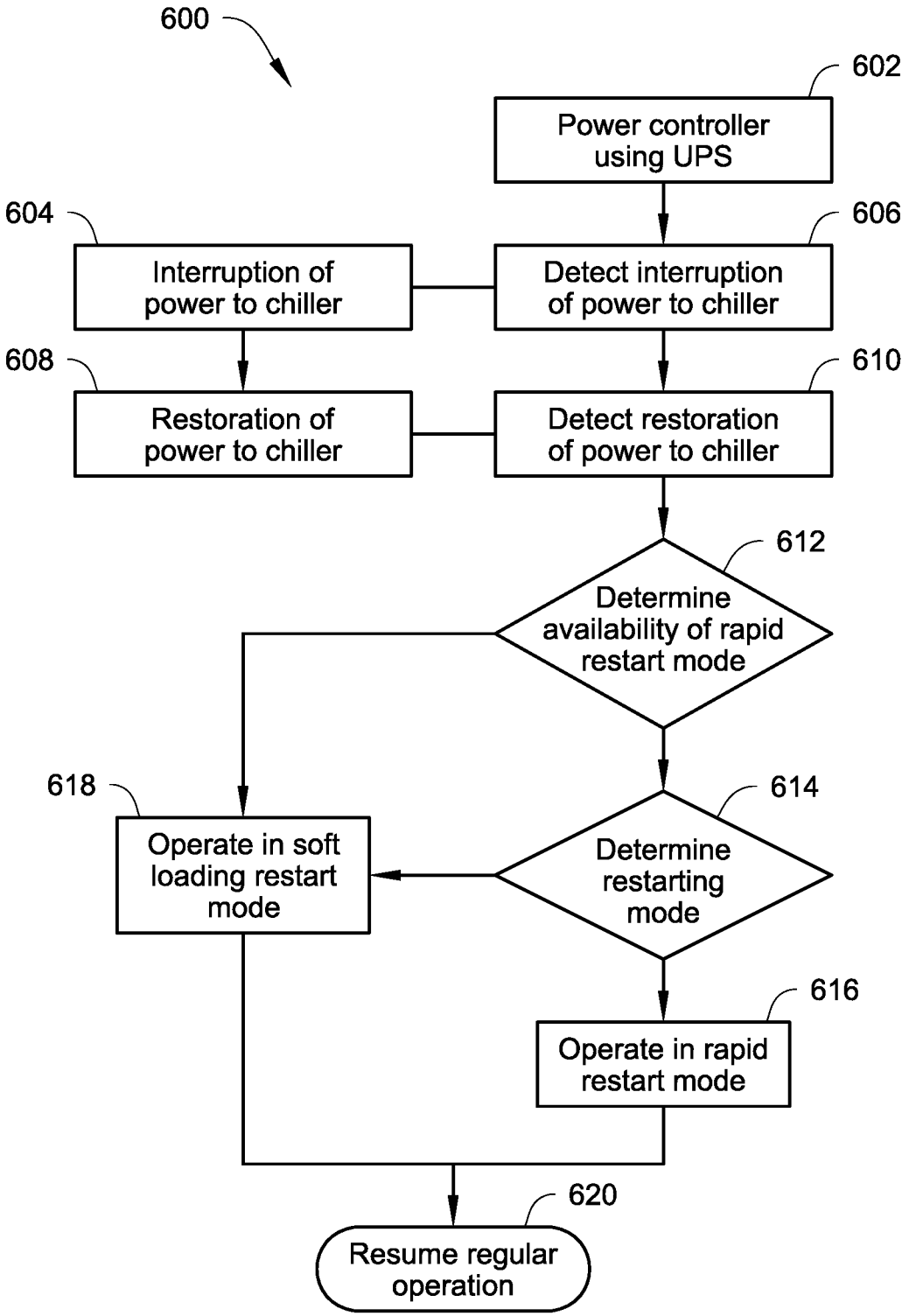
FIG. 6 shows a flowchart for determining a restarting mode according to an embodiment.

FIG. 6 shows a flowchart for determining a restarting mode according to an embodiment. In method 600, a controller receives power from a UPS 602. While the controller receives power from the UPS at 602, a chiller controlled by the controller experiences an interruption of power at 604. The interruption of power to the chiller that occurs at 604 is detected at 606. The chiller experiences a restoration of power at 608. The restoration of power to the chiller that occurs at 608 is detected at 610. Optionally, the controller checks whether a rapid restart capability is enabled 612. The controller determines a restarting mode for the chiller system at 614. When the determined restarting mode is a rapid restart mode, the chiller system is restarted according to the rapid restart mode 616. When the determined restarting mode is a soft loading restart mode, the chiller system is restarted according to the soft loading restart mode 618. When either the rapid restart mode 616 or the soft loading restart mode 618 concludes, the chiller system can continue in regular operations 620.

The controller receives power from a UPS at 602. The power supplied by the UPS to the controller can include power supplied by a power supply also servicing the other powered components of the chiller system. The UPS can include one or more additional power sources to maintain continuity of power to the controller even when power to the other powered components is interrupted.

The chiller experiences an interruption of power at 604. The interruption of power can be, for example, due to loss of power from a utility, failure at local generation facilities, faults in the system conveying power to the chiller system, or any other disruption of the supply of power to the chiller system. Upon the interruption of power 604, the powered chiller components may shut down due to the lack of power being supplied. Since the controller receives power from a UPS, the controller maintains power and continues operation. The UPS supplying power to the controller 602 can use at least one of the one or more additional power sources to continue the supply of power to the controller 602 while the chiller is experiencing the interruption of power at 604.

The interruption of power to the chiller at 604 is detected at 606. The interruption of power can be detected by any suitable sensor or other suitable device for determining power status. As a non-limiting example, the detection at 606 of interruption of power to the chiller 604 can be performed by a circuit configured to detect whether the powered chiller components are currently receiving power, such as power detection circuit 304 described above and shown in FIG. 3. The detected interruption of power can be obtained by the controller, which does not itself experience the interruption of power since it is instead receiving power from the UPS. The detected interruption of power to the chiller can be logged at the controller when it is detected at 606.

Power can be restored to the chiller powered components at 608. The restoration of power allows chiller powered components to be operated again following the interruption at 604. The restoration of power at 608 can be detected at 610. The detection of the restoration of power can be performed using any suitable sensor or other device for determining power status. In an embodiment, detection of the restoration of power at 610 can be performed using the same sensor or other device for determining power status that is used to detect the interruption at 606. The restoration of power at 610 can be logged at the controller.

Optionally, it can be determined whether a rapid restart capability is enabled at 612. The controller can reference a memory storing data regarding whether the rapid restart mode is enabled. The memory can store, for example, user input, factory settings, or other directions regarding whether the controller can select and operate in the rapid restart mode. When it is determined at 612 that the rapid restart mode is not enabled, the method 600 can proceed directly to restarting the chiller in the soft loading restart mode 618. In method 600, the determination of whether the rapid restart mode is enabled at 612 can occur at any point prior to the determination of the restarting mode at 614, without respect to the timing of the interruption or restoration of power to the chiller, or the corresponding detection of the interruption or restoration.

A restarting mode for the chiller is determined at 614. The restarting mode can be determined based on the operation of the chiller system at the time of the interruption of power at 604 and the duration of time from the interruption of power at 604 until the restoration of power at 608. The operation of the chiller system can be used in part to determine the restarting mode. In an embodiment, when the chiller was not in operation at the time of the interruption of power at 604, the restarting mode can be determined to be the soft loading restart mode and the method 600 can proceed to 618. In this embodiment, when the chiller was in operation at the time of the interruption of power at 604, the determination is further based on the duration of time from the interruption at 604 to the restoration at 608. The duration of time can be determined from the detection of the interruption at 606 and the detection of the restoration at 610, for example from logged data at the controller. The duration of time can be compared to a threshold value, with a duration below the threshold leading to determination leading to a determination to restart in the rapid restart mode, and with a duration above the threshold leading to a determination to restart in the soft loading restart mode. The threshold value can be a value selected based on the characteristics of the chiller system and/or the cooling load served by the chiller system. The threshold value can be based on the characteristics of the system in which the chiller is installed, for example continuity of power standards for a particular installation. The threshold value can be any suitable period of time within which the target for a rapid restart of the chiller could be estimated or known. The threshold value can be based on risks of control instability, shutdown of the load served by the chiller system, or the like. In an embodiment, the threshold value can be at or about 10 minutes or less. In an embodiment the threshold value can be at or about 5 minutes or less.

When it is determined at 614 to restart in the rapid restart mode, the chiller system can be restarted according to the rapid restart mode at 616. The rapid restart mode 616 can be a more aggressive approach to restarting the chiller system and increasing capacity of the chiller during the restarting process, as described above with respect to rapid restart mode 408 described above. In an embodiment, the rapid restart mode carried out at 616 can be an adaptive rapid restart mode as discussed above. The rapid restart mode 616 can continue until a target is reached, at which point the chiller system can enter regular operations 620.

When it is determined at 614 to restart in the soft loading restart mode, or when it is determined at 612 that the rapid restart mode is not enabled, the chiller system can be restarted according to the soft loading restart mode at 618.

The soft loading restart mode 618 can provide a comparatively slower, more tightly constrained increase in capacity of the chiller system during the restarting process, as described above with respect to soft loading restart mode 410 described above. The soft loading restart mode 618 can continue until a target is reached, at which point the chiller system can enter regular operations 620.

Aspects

It is understood that any of aspects 1-9 can be combined with any of aspects 10-16.

Aspect 1. A chiller system, comprising a chiller; and a controller, configured to:

determine a restarting mode for the chiller, when power to the chiller is restored following an interruption, wherein the restarting mode is one of a soft loading restart mode or a rapid restart mode; and control the chiller according to the determined restarting mode, wherein the soft loading restart mode includes a limit on a rate of increase for chiller capacity, and the rapid restart mode reestablishes chiller capacity to a level at which the chiller was operation prior to the interruption more rapidly than the soft loading restart mode.

Aspect 2. The chiller system according to aspect 1, wherein the controller is configured to determine the restarting mode based on an operational state of the chiller at a time of interruption of power to the chiller.

Aspect 3. The chiller system according to any of aspects 1-2, wherein the controller is configured to receive power from an uninterruptable power source.

Aspect 4. The chiller system according to aspect 3, wherein the controller is configured to determine the restarting mode based on a duration of interruption of power to the chiller compared to a threshold duration.

Aspect 5. The chiller system of according to any of aspects 1-4, further comprising an uninterruptable power source.

Aspect 6. The chiller system according to any of aspects 1-5, further comprising a circuit configured to detect when power is interrupted at the chiller, and wherein the controller is configured to receive a signal from the circuit, the signal indicative of when power is interrupted at the chiller.

Aspect 7. The chiller system according to any of aspects 1-6, wherein the controller is configured to, when the restarting mode is determined to be the rapid restart mode, control the chiller according to the rapid restart mode until the chiller reaches a capacity corresponding to a current load on the chiller.

Aspect 8. The chiller system according to any of aspects 1-7, wherein the rapid restart mode is an adaptive rapid restart mode wherein the rate of increase for chiller capacity is determined based on the level at which the chiller was operating at prior to the interruption more rapidly than the soft loading restart mode.

Aspect 9. A method of controlling a chiller system, comprising:

determining when power to a chiller of the chiller system has been interrupted;

receiving power at the chiller of the chiller system;

determining, using a controller, whether to restart the chiller in a soft loading restart mode or a rapid restart mode; and operating the chiller, using the controller, according to the determined restarting mode, wherein the soft loading restart mode includes a limit on a rate of increase for chiller capacity, and the rapid restart mode reestablishes chiller capacity to a level at which the chiller was operation prior to the interruption more rapidly than the soft loading restart mode.

Aspect 10. The method according to aspect 9, wherein determining whether to restart the chiller in the soft loading restart mode or the rapid restart mode is based on an operational state of the chiller at a time of interruption of power to the chiller.

Aspect 11. The method according to any of aspects 9-10, wherein determining whether to restart the chiller in the soft loading restart mode or the rapid restart mode is based on a duration of interruption of power to the chiller compared to a threshold duration.

Aspect 12. The method according to any of aspects 9-11, wherein the controller receives power from an uninterruptable power source.

Aspect 13. The method according to aspect 12, wherein determining when power to the chiller is interrupted includes detecting the interruption at a circuit and receiving at the controller a signal from the circuit.

Aspect 14. The method according to any of aspects 9-13, wherein when it is determined to restart the chiller in the rapid restart mode, the method includes controlling the chiller according to the rapid restart mode is performed until the chiller reaches a capacity corresponding to a current load on the chiller.

Aspect 15. The method according to any of aspects 9-14, wherein the rapid restart mode is an adaptive rapid restart mode and wherein the method further includes determining the rate of increase for chiller capacity based on the level at which the chiller was operation prior to the interruption more rapidly than the soft loading restart mode.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A chiller system, comprising a chiller; and a controller, configured to:

when power to the chiller is restored following an interruption, obtain an operating condition of the chiller at a time of the interruption, wherein the operating condition includes whether the chiller was in operation at the time of the interruption; and determine a restarting mode for the chiller based on the operating condition and a duration of time from the interruption to when the power to the chiller is restored, wherein:

the interruption includes at least one of: loss of power from a utility, failure at a local generation facility, or a fault in a system conveying power to the chiller system;

the restarting mode is one of a soft loading restart mode or a rapid restart mode, the soft loading restart mode is determined when the duration of time from the interruption to when the power is restored is greater than a predetermined period of time or when the chiller was deactivated at the time of the interruption, and the rapid restart mode is determined when the chiller was in operation at the time of the interruption and the duration of time from the interruption to when the power is restored is less than the predetermined period of time; and control the chiller according to the determined restarting mode, wherein the soft loading restart mode includes a limit on a rate of increase for chiller capacity, the rapid restart mode reestablishes chiller capacity to a level at which the chiller was operating prior to the interruption more rapidly than the soft loading restart mode, and the rapid restart mode is an adaptive rapid restart mode wherein the rate of increase for chiller capacity is determined based on the level at which the chiller was operating prior to the interruption.

2. The chiller system of claim 1, wherein the controller is configured to receive power from an uninterruptable power source.

3. The chiller system of claim 1, further comprising an uninterruptable power source.

4. The chiller system of claim 1, further comprising a circuit configured to detect when power is interrupted at the chiller, and wherein the controller is configured to receive a signal from the circuit, the signal indicative of when power is interrupted at the chiller.

5. The chiller system of claim 1, wherein the controller is configured to, when the restarting mode is determined to be the rapid restart mode, control the chiller according to the rapid restart mode until the chiller reaches a capacity corresponding to a current load on the chiller.

6. A method of controlling a chiller system, comprising:

determining when power to a chiller of the chiller system has been interrupted, wherein said interruption includes at least one of: loss of power from a utility, failure at a local generation facility, or a fault in a system conveying power to the chiller system;

receiving a restoration of power at the chiller of the chiller system;

obtaining, at a controller, an operating condition of the chiller at a time of the interruption, wherein the operating condition includes whether the chiller was in operation at the time of the interruption;

determining, using the controller, whether to restart the chiller in a soft loading restart mode or a rapid restart mode, based on the operating condition and a duration of time from the interruption to when the power to the chiller is restored, the soft loading restart mode is determined when the duration of time from the interruption to when the power is restored is greater than a predetermined period of time or when the chiller was deactivated at the time of the interruption, and the rapid restart mode is determined when the chiller was in operation at the time of the interruption and the duration of time from the interruption to when the power is restored is less than the predetermined period of time; and operating the chiller, using the controller, according to the determined restarting mode, wherein the soft loading restart mode includes a limit on a rate of increase for chiller capacity, the rapid restart mode reestablishes chiller capacity to a level at which the chiller was operating prior to the interruption more rapidly than the soft loading restart mode, and the rapid restart mode is an adaptive rapid restart mode and wherein the method further includes determining the rate of increase for chiller capacity based on the level at which the chiller was operating prior to the interruption.

7. The method of claim 6, wherein the controller receives power from an uninterruptable power source.

8. The method of claim 7, wherein determining when power to the chiller is interrupted includes detecting the interruption at a circuit and receiving at the controller a signal from the circuit.

9. The method of claim 6, wherein when it is determined to restart the chiller in the rapid restart mode, the method includes controlling the chiller according to the rapid restart mode is performed until the chiller reaches a capacity corresponding to a current load on the chiller.

* * * * *